US007458364B2

(12) United States Patent
Allen

(10) Patent No.: US 7,458,364 B2
(45) Date of Patent: Dec. 2, 2008

(54) INTERNAL COMBUSTION ENGINE HAVING A FUEL INJECTION SYSTEM

(75) Inventor: Jeffrey Allen, Attleborough (GB)

(73) Assignee: Scion-Sprays Limited, Hethel, Norwich Norfolk (GB)

( * ) Notice: Subject to any disclaimer, the term of this patent is extended or adjusted under 35 U.S.C. 154(b) by 0 days.

(21) Appl. No.: 11/461,919

(22) Filed: Aug. 2, 2006

(65) Prior Publication Data

US 2007/0028900 A1 Feb. 8, 2007

(30) Foreign Application Priority Data

Aug. 5, 2005 (GB) ..... 0516102.1
Aug. 5, 2005 (GB) ..... 0516235.9
Oct. 28, 2005 (GB) ..... 0522068.6

(51) Int. Cl.
*F02M 37/04* (2006.01)
*F02M 23/00* (2006.01)

(52) U.S. Cl. ..... 123/497; 123/499; 123/531; 123/533

(58) Field of Classification Search ..... 123/531, 123/533, 537, 497, 498, 499; 239/87
See application file for complete search history.

(56) References Cited

U.S. PATENT DOCUMENTS 1,562,539 A * 11/1925 Cole ..... 123/430
2,033,155 A * 3/1936 Scott ..... 123/261
3,937,195 A 2/1976 Woods
3,980,056 A * 9/1976 Kraus ..... 123/27 A
3,996,915 A 12/1976 Demetrescu
4,140,088 A 2/1979 de Vulpillieres
4,499,871 A * 2/1985 Neitz et al. ..... 123/276

(Continued)

FOREIGN PATENT DOCUMENTS

DE 672572 3/1939

(Continued)

OTHER PUBLICATIONS

Search Report for GB0516102.1 (Dec. 7, 2005).

(Continued)

*Primary Examiner*—Stephen K. Cronin
*Assistant Examiner*—J. Page Hufty
(74) *Attorney, Agent, or Firm*—Luedeka, Neely & Graham, PC

(57) ABSTRACT

With reference to Figure, the present invention provides a fuel injection system for an internal combustion engine which delivers fuel to be mixed with charge air for subsequent combustion in a combustion chamber of the internal combustion engine. The fuel injection system comprises a fuel injector which functions as a positive displacement pump and dispenses in each operation thereof a set quantity of fuel;

a mixing chamber into which the fuel injector dispenses fuel; and a gas supply passage for supplying gas to the mixing chamber to entrain the fuel dispensed into the mixing chamber in a flow of gas which passes through the mixing chamber into the combustion chamber. The mixing chamber is connected to the combustion chamber to deliver fuel and gas into the combustion chamber separately from the charge air and a depression in the combustion chamber is used to draw gas through the gas supply passage into the combustion chamber. An inlet valve controls flow of charge air into the combustion chamber and the inlet valve is kept closed for an initial part of an intake stroke of the engine so that the depression is created in the combustion chamber.

21 Claims, 3 Drawing Sheets

U.S. PATENT DOCUMENTS

| | | | | |
|---|---|---|---|---|
| 4,499,878 | A | 2/1985 | Igashira et al. | |
| 4,524,743 | A | 6/1985 | McAuliffe, Jr. et al. | |
| 4,649,886 | A | 3/1987 | Igashira et al. | |
| 4,653,455 | A | 3/1987 | Eblen et al. | |
| 4,928,655 | A | 5/1990 | Kako | |
| 4,930,482 | A | 6/1990 | Kako | |
| 5,092,301 | A | 3/1992 | Ostdiek | |
| 5,261,369 | A | 11/1993 | Vernier | |
| 5,390,647 | A | 2/1995 | Schechter | |
| 5,685,485 | A | 11/1997 | Mock et al. | |
| 5,810,264 | A | 9/1998 | Yost | |
| 5,934,567 | A | 8/1999 | Fly | |
| 6,209,315 | B1 | 4/2001 | Weigl | |
| 6,314,948 | B1 * | 11/2001 | Cathcart | 123/533 |
| 6,354,079 | B1 | 3/2002 | Choi et al. | |
| 6,516,607 | B1 | 2/2003 | Bruck et al. | |
| 6,581,581 | B1 | 6/2003 | Bebich | |
| 6,804,997 | B1 | 10/2004 | Schwulst | |
| 6,899,089 | B2 * | 5/2005 | Shiraishi et al. | 123/533 |
| 6,912,991 | B2 | 7/2005 | Herden | |
| 6,955,081 | B2 | 10/2005 | Schwulst | |
| 7,225,793 | B2 | 6/2007 | Schwulst et al. | |
| 2003/0061870 | A1 | 4/2003 | Lodise et al. | |
| 2004/0016417 | A1 | 1/2004 | Kerns et al. | |
| 2004/0040534 | A1 | 3/2004 | Herden | |
| 2005/0039526 | A1 | 2/2005 | Schwulst | |

FOREIGN PATENT DOCUMENTS

| | | | |
|---|---|---|---|
| DE | 19544241 | | 6/1996 |
| DE | 19544241 | A1 | 6/1996 |
| DE | 19846310 | A1 | 4/2000 |
| DE | 10014553 | | 10/2001 |
| DE | 10014553 | A1 | 10/2001 |
| EP | 1367255 | A1 | 2/2001 |
| EP | 1197657 | A2 | 4/2002 |
| EP | 1340906 | A1 | 9/2003 |
| EP | 1394398 | A2 | 3/2004 |
| EP | 1460261 | A1 | 9/2004 |
| GB | 1138536 | | 1/1969 |
| GB | 2072261 | | 9/1981 |
| GB | 2072261 | A | 9/1981 |
| GB | 2222435 | A | 3/1990 |
| GB | 2318388 | | 4/1998 |
| GB | 2318388 | A | 4/1998 |
| JP | 60017250 | | 7/1983 |
| JP | 59087238 | | 5/1984 |
| JP | 60017250 | | 1/1985 |
| JP | 62075064 | | 6/1987 |
| SU | 1041731 | A | 9/1983 |
| WO | WO0028194 | | 5/2000 |
| WO | WO2004038189 | A1 | 5/2004 |

OTHER PUBLICATIONS

Search Report for GB0516235 (Sep. 27, 2005).
Search Report for GB0516235.9 (Oct. 19, 2005).
Search Report for GB0522066 (Oct. 23, 2006).
Search Report for GB0522066.0 (Mar. 13, 2006).
Search Report for GB0522068 (Jan. 9, 2006).
Search Report for GB0522068.6 (Mar. 29, 2006).
Search Report for GB0522068.6 (Oct. 18, 2007).
Search Report for GB0606104.8 (May 18, 2006).
Search Report for GB0606185.7 (Jul. 27, 2006).
Search Report for GB0703878.9 (May 14, 2007).
Search Report for GB0703878.9 (Sep. 20, 2007).
Search Report for GB0703878.9 (Sep. 26, 2007).
Search Report for GB0703880.5 (May 1, 2007).
Search Report for PCT/GB2006/002840 (Jul. 31, 2006).
Search Report for PCT/GB2006/002858 (Jul. 31, 2006).
Patent Acts 1977, Search Report for GB 0513102.1 Under Section 17, Dec. 6, 2005, 1 p., John Twin.
Patent Acts 1977, Search Report for GB 0516235.9 Under Section 17, Oct. 19, 2005, 1 p., John Twin.
European Patent Office, Standard Search Report for GB 0516235, Sep. 16, 2005, 3 pp., P. Lapeyronnie.

* cited by examiner

INTERNAL COMBUSTION ENGINE HAVING A FUEL INJECTION SYSTEM

BACKGROUND OF THE INVENTION

The present invention relates to an internal combustion engine having a fuel injection system.

Most internal combustion engines in automobiles currently use fuel injection systems to supply fuel to the combustion chambers of the engine. Some fuel injection systems have fuel injectors which inject fuel directly into a combustion chamber of an engine. It is a problem to ensure that such fuel is properly atomised.

Most fuel injection system are designed to meter fuel accurately and are not fuel atomisation devices. It is recognised that a finely atomised fuel spray will improve air fuel mixing and will help reduce engine emissions. It is therefore advantageous to incorporate an atomisation feature into the fuel injector. This is difficult with conventional injectors since if the atomisation process has any variable effect on the pressure difference across the injector this can alter the flow rate of fuel through the injector and cause incorrect fuel quantities to be delivered to the engine. Therefore, choosing an effective atomisation process is very limited with the conventional fuel injection systems and the current "state of the art" injection systems overcome this problem by using a complex highly controlled high pressure fuel system where the high kinetic energy in the fuel can aid atomisation.

The sophisticated and highly developed fuel injection systems currently available are ideal for use in internal combustion engines in automobiles. However, there are many other applications for internal combustion engines where such a level of sophistication is not appropriate and too costly. For instance, small single cylinder engines as used for lawn mowers, chain saws, small generators, mopeds, scooters, etc are built to very tight cost targets and so cannot afford the cost of a sophisticated fuel injection system nor the additional power required to run a fuel pump. To date, such small engines have used traditional carburettor technology and relied on a gravity fed fuel supply. However, it is now the case that such small engines will face the same type of exhaust gas emission legislation as the engines in automobiles and so must be modified in such a way as to meet emissions targets. Therefore, a cheap and simple system of fuel injection is required for such small engines.

SUMMARY OF THE INVENTION

According to a first aspect of the invention, there is provided an internal combustion engine having a fuel injection system which delivers fuel directly into a combustion chamber of the engine for mixing with charge air delivered separately to the combustion chamber via an inlet valve, the fuel injection system comprising a fuel injector which functions as a positive displacement pump and dispenses in each operation thereof a set quantity of fuel;

a mixing chamber into which the fuel injector dispenses fuel; and a gas supply passage for supplying gas to the mixing chamber to entrain the fuel dispensed into the mixing chamber in a flow of gas which passes through the mixing chamber into the combustion chamber; wherein:

the mixing chamber is connected to the combustion chamber to deliver fuel and gas into the combustion chamber separately from the charge air and a depression in the combustion chamber is used to draw gas through the gas supply passage into the combustion chamber; and the inlet valve controls flow of charge air into the combustion chamber and the inlet valve is kept closed for an initial part of an intake stroke of the engine so that the depression is created in the combustion chamber.

According to a second aspect of the invention the present invention provides an internal combustion engine having a fuel injection system which delivers fuel directly into a combustion chamber for mixing with charge air delivered separately to the combustion chamber via an inlet valve, the fuel injection system comprising:

a fuel injector which functions as a positive displacement pump and dispenses in each operation thereof a set quantity of fuel;

a mixing chamber into which the fuel injector dispenses fuel; and a gas supply passage for supplying gas to the mixing chamber to entrain the fuel dispensed into the mixing chamber in a flow of gas which passes through the mixing chamber into the charge air; wherein:

the mixing chamber is connected to the combustion chamber to deliver fuel and gas into the combustion chamber separately from the charge air and a depression in the combustion chamber is used to draw gas through the gas supply passage into the combustion chamber;

the inlet valve controls flow of charge air into the combustion chamber and the inlet valve is kept closed for an initial part of an intake stroke of the engine so that the depression is created in the combustion chamber; and the fuel injector dispenses an amount of fuel which is fixed for each and every operation of the injector.

According to a third aspect of the invention the present invention, the present invention provides an internal combustion engine having a fuel injection system which delivers fuel directly into a combustion chamber for mixing with charge air delivered separately to the combustion chamber via an inlet valve, the fuel injection system comprising:

a fuel injector which functions as a positive displacement pump and dispenses in each operation thereof a set quantity of fuel;

a mixing chamber into which the fuel injector dispenses fuel; and a gas supply passage for supplying gas to the mixing chamber to entrain the fuel dispensed into the mixing chamber in a flow of gas which passes through the mixing chamber into the charge air; wherein:

the mixing chamber is connected to the combustion chamber to deliver fuel and gas into the combustion chamber separately from the charge air and a depression in the combustion chamber is used to draw gas through the gas supply passage into the combustion chamber; and the inlet valve controls flow of charge air into the combustion chamber and the inlet valve is kept closed for an initial part of an intake stroke of the engine so that the depression is created in the combustion chamber; and fuel and gas leaving the mixing chamber pass through an atomising nozzle prior to mixing with the charge air.

According to a fourth aspect of the invention the present invention provides an internal combustion engine having a fuel injection system which delivers fuel directly into a combustion chamber for mixing with charge air delivered separately to the combustion chamber via an inlet valve, the fuel injection system comprising:

a fuel injector which functions as a positive displacement pump and dispenses in each operation thereof a set quantity of fuel;

a mixing chamber into which the fuel injector dispenses fuel; and a gas supply passage for supplying gas to the mixing chamber to entrain the fuel dispensed into the mixing chamber in a flow of gas which passes through the mixing chamber into the charge air; wherein:

the mixing chamber is connected to the combustion chamber to deliver fuel and gas into the combustion chamber separately from the charge air and a depression in the combustion chamber is used to draw gas through the gas supply passage into the combustion chamber;

the inlet valve controls flow of charge air into the combustion chamber and the inlet valve is kept closed for an initial part of an intake stroke of the engine so that the depression is created in the combustion chamber; and the fuel injector dispenses an amount of fuel which is fixed for each and every operation of the injector;

the fuel and gas leaving the mixing chamber pass through an atomising nozzle prior to mixing with the charge air; and the atomising nozzle further includes a pintle, the pintle being operated simultaneously with the fuel injector.

According to a fifth aspect of present invention, there is provided a method of delivering fuel into a combustion chamber separately from charge air delivered via an inlet valve to the combustion chamber, the method comprising the steps of:

dispensing a set quantity of fuel from a fuel injector to a mixing chamber; and entraining the fuel in the mixing chamber in a flow of gas, with the flow delivering the fuel to the combustion chamber via an atomising nozzle; wherein:

a depression is created in the combustion chamber in an early part of an intake stroke of the engine by keeping closed the inlet valve and the depression is used to draw through the atomising nozzle the gas used to entrain the dispensed fuel.

Internal combustion engines that make use of embodiments of the invention can do away with complicated, heavy and expensive fuel injection systems. Instead, they may make use of a cheaper and simpler system that does not require the pressure within the inlet passage to be monitored or the provision of a fuel pump and pressure regulator to maintain a constant pressure differential between the fuel and the charge air. Rather, the fuel injector of the current invention dispenses a known quantity of fuel at a fixed flow rate independent of the pressure of the charge air. The vacuum drawn in the combustion chamber by piston motion while the inlet valve is closed is used to draw in air through the mixing chamber to entrain injected fuel and atomise the fuel as the fuel and air mixture is drawn through the atomising nozzle. There is no need for an air pump as used in known gasoline direct injection engines. The ability to deliver fuel in this way also allows a simpler apparatus for dispersing the fuel in the charge air and the use of low cost effective atomisation processes without effecting the accurate fuel quantity being delivered, so allowing simple small engines to benefit from well atomised accurate full flow rates.

BRIEF DESCRIPTION OF THE DRAWINGS

Embodiments of the invention shall now be described with reference to the accompanying drawings, in which.

DETAILED DESCRIPTION

Figure 1:
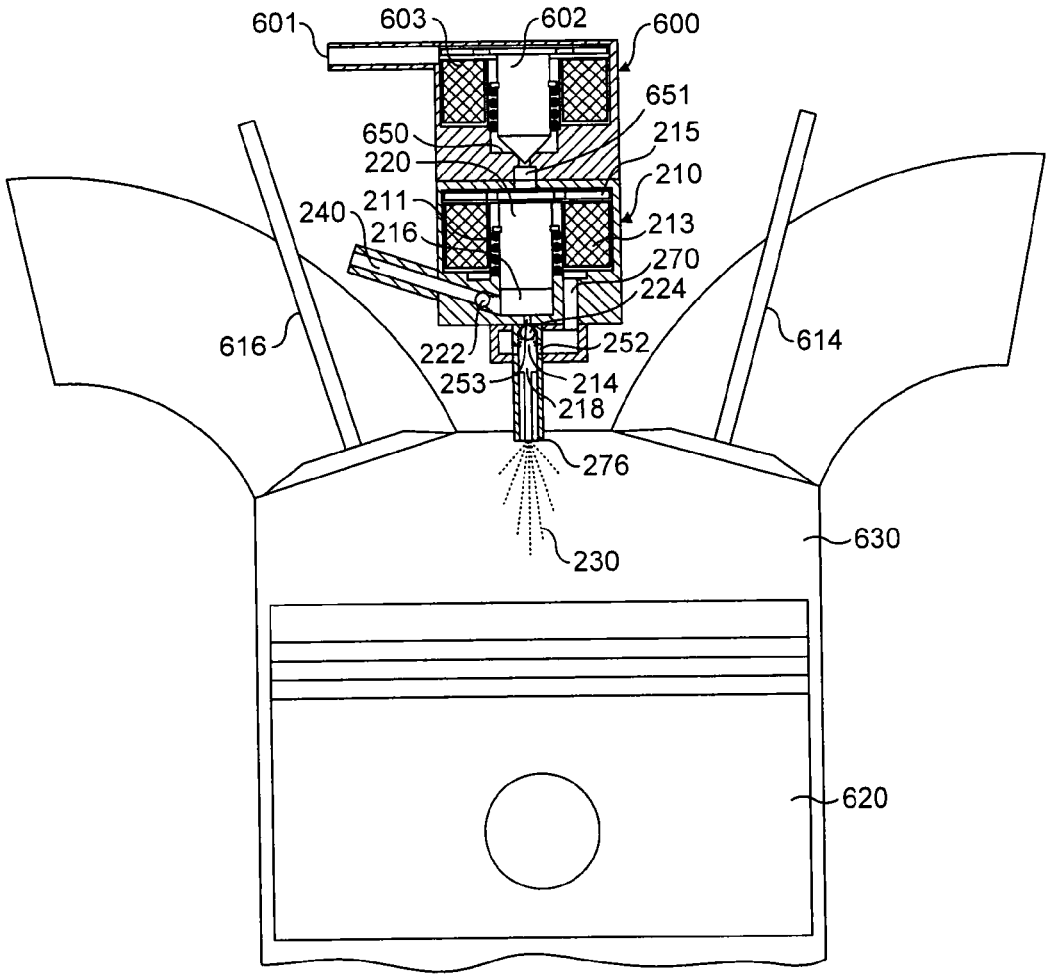
FIG. 1 is a schematic representation of a fuel injector of the present invention arranged for direct injection into the combustion chamber.

A first embodiment of the invention uses a fuel injector 210 and nozzle 276. The fuel injector 210 provides direct injection of fuel into the combustion chamber 630 of an engine. FIG. 1 shows an internal combustion engine in which a piston 620 cooperates with a cylinder to define a combustion chamber 630. Also shown are an inlet valve 614 controlling flow of charge air into the combustion chamber 630 and an exhaust valve 616 controlling flow of exhaust gas from the combustion chamber 630. A sonic nozzle 276 of the fuel injector 210 is arranged to dispense fuel directly into the combustion chamber 630 of the engine. The fuel injector 210 comprises a fuel inlet 240, a fuel outlet 214 and a fuel chamber 216. The fuel inlet 240 of the fuel injector 210 is connected to a supply of fuel and communicates via spring-loaded one-way inlet valve 222 with the fuel chamber 216. A second spring-loaded one-way outlet valve 224 controls the flow of fuel out of the fuel chamber 216 to the fuel outlet 214.

The fuel chamber 216 itself is defined by a piston 220 which is slidably located within a body of the fuel injector 210. The piston 220 is acted upon by a biasing spring 211 and surrounded by a solenoid 213. An end plate 215 is connected to the piston 220 at an end remote from the fuel chamber 216 and extends radially outwardly from the piston across an end face of the solenoid 213. The solenoid 213 is connected by a line (not shown) to an engine control unit (also, not shown).

Starting from a condition in which the piston 220 is biased to its uppermost point within the body of the fuel injector 210 by the biasing spring 211 (i.e. the point at which the fuel chamber 216 has its greatest volume), the fuel chamber 216 will be primed with fuel ready for injection. Energisation of the solenoid 213 then acts to pull the end plate 215 into contact or near contact with the solenoid 213. The piston 220 moves downwards against the force of the basing spring 211 to reduce in volume the fuel chamber 216. This causes the positive displacement of fuel from the fuel chamber 216, the one-way outlet valve 224 opening to allow the piston 220 to expel fuel from the fuel chamber 216 to the fuel outlet 214 while the one-way inlet valve 222 remains closed.

Once the solenoid 213 is de-energised, the biasing spring 211 will force the piston 220 upwardly and the end plate 215 away from the solenoid 213. The upward motion of the piston 220 will cause the fuel chamber 216 to increase in volume and this will have the effect of closing the one-way outlet valve 224 and opening the one-way inlet valve 222. The moving piston 220 draws fuel from the fuel inlet 240 into the fuel chamber 216 to fully charge the fuel chamber 216 ready for the next dispensing of fuel.

The fuel injector 210 is constructed so that the piston 220 has a set distance of travel in each operation. The piston 220 moves between two end stops. Thus, in each operation of the fuel injector 210, the piston 220 displaces a predetermined quantity of fuel and a predetermined quantity of fuel is dispensed out of the fuel outlet 214. The amount of fuel dispensed by the fuel injector 210 is constant for each and every operation.

Having been dispensed from the fuel chamber 216, the fuel is forced via the fuel outlet 214 to a mixing chamber 218 and then via an atomising nozzle 276 to the combustion chamber 630. The atomising nozzle 226 of the present invention is a sonic nozzle (also known in the art as a critical flow venturi, or critical flow nozzle). The atomising nozzle could also be an air-blast nozzle.

Figure 3:
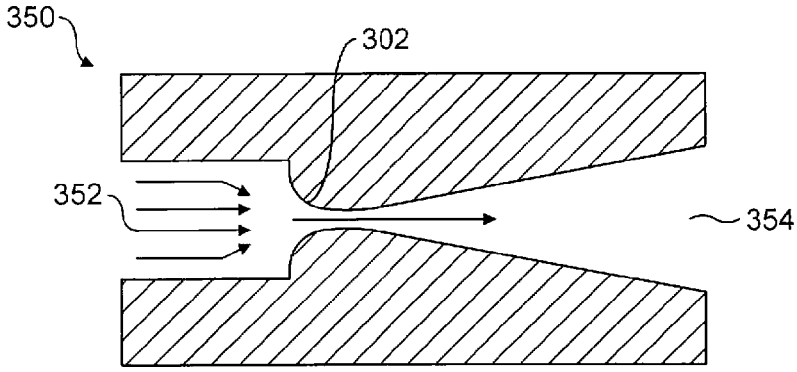
FIG. 3 shows a cross-sectional view of a nozzle of the fuel injector of FIG. 2.

A schematic diagram of a sonic nozzle is shown in FIG. 3. The nozzle comprises a venturi 350, the internal dimensions of which narrow to provide a throat 302. The fluid upstream 352 of the throat 302 is provided at a higher pressure than that downstream 354 of the throat. The fluid flows into the nozzle and is accelerated in the narrowed throat region. The velocity of the fluid in the narrowed region approaches the speed of sound. Once this condition has been realised the flow rate through the sonic nozzle will remain constant even if the downstream pressure varies significantly, provided, of course, that the pressure differential across the nozzle continues to exceed the threshold valve. Thus in the present case a constant fuel flow rate into the charge air is achieved. It should be noted that a sonic nozzle will provide a constant flow rate regardless of the abruptness of the change in downstream pressure provided that the downstream pressure remains at less than about 85-90% of the upstream pressure.

In the current invention the passage of fuel through the sonic nozzle 276 also aids in dispersing the fuel into the charge air. In fact, since the velocity of the fuel passing through the venturi 350 approaches the speed of sound, the nozzle 276 acts as a highly efficient atomizer breaking the liquid fuel up into a mist of tiny particles. Generally, the finer the spray of fuel in the charge air, the better the combustion process achieved. While the exact operation of sonic nozzles in atomizing fuel is not well understood, it is thought that the passage of the liquid fuel through the shock waves in the high velocity region of the sonic nozzle produces very high shear stresses on the liquid surface and cavitation bubbles within the liquid, both of these processes leading to very fine atomisation and dispersion of the fuel into the charge air.

In conventional fuel injection systems the pressure differential between the fuel and charge air must be constantly regulated to allow the amount of fuel dispensed by the injectors to be accurately determined. This prevents the use of sonic nozzles. However, in the current invention the fuel injector does not require the fuel-to-charge air pressure ratio to be precisely controlled. Hence, the use of sonic nozzles becomes possible.

In conventional fuel injection systems, the fuel is pressurised and the or each fuel injector simply acts as an on/off switch to control the amount of fuel dispensed. In contrast, the present fuel injector is intended to be operated using a pulse. The fuel injector 210 in each operation dispenses a fixed volume of fuel. Due to changing load conditions on the engine, the amount of fuel to be injected for combustion will have to be increased or decreased. To meet this requirement the injector 210 is operated by a pulse count injector method which uses multiple operations of the fuel injector 210 in each engine cycle. When the engine is at the part of the cycle at which fuel injection must occur, multiple operations of the fuel injector 210 take place. To increase or decrease the amount of fuel dispensed, the number of operations of the injector 210 is adjusted accordingly. For example, under normal loading conditions the number of operations may be, say, ten. For higher load conditions the number is increased to fourteen, for example, or for reduced load conditions the number of pulses may be reduced to, say, six.

For a conventional engine with a fuel injection system the timing of the fuel injection is critical. Both the duration for which the on/off valves are open, and the point in the engine cycle at which the fuel is dispensed must both be accurately controlled. The combination of a pulse count injection system with a sonic nozzle overcomes many of the timing problems associated with the prior art. In a pulse count injection system using a sonic nozzle the volume of fuel delivered in each engine cycle is easily determined. Successive operations of the fuel injector 210 (in a single engine cycle) in a pulse count injection system can be easily provided for.

In an alternative embodiment, the piston 220 may be configured to deliver a number of different volumes of fuel. This may be achieved by only partially retracting the piston 220. There are other ways of implementing such a variable volume injection device, for example a diesel fuel injector with a variable stroke can be used to give a variable, but known quantity of fuel.

The mixing chamber 218 is located between the fuel chamber 216 and the nozzle 276. The mixing chamber 218 is connected to receive air via an air bypass 270, orifices, e.g. 252. are shown allowing this. This is a passage which communicates with both the mixing chamber 218 and a region where air is at atmospheric pressure.

During operation of the fuel injector 210, the piston 220 moves to expel the fuel from the fuel chamber 216. The fuel then passes through the mixing chamber 218 and on through the sonic nozzle 276. The fuel is expelled under the pressure provided by the piston. The dispensing of the fuel is timed to coincide with low pressure conditions inside the combustion chamber 630. As the fuel is expelled, the low pressure conditions in the combustion chamber 630 draws air from the air bypass passage 240 and the air flows through the mixing chamber 218 and entrains the fuel in the mixing chamber 218, the fuel and air passing through the atomising nozzle 276 into the combustion chamber 630. The flow through the high velocity region in the nozzle 276 causes the stream of fuel to be broken up. This improves the break up and atomisation of the stream of fuel as it is ejected from the sonic nozzle 226.

The opening of the inlet valve 614 of the engine is delayed at the start of the intake stroke of the engine and movement of the piston 620 is used to create a partial vacuum in the combustion chamber 630. The fuel is dispensed into the mixing chamber 218 with the partial vacuum drawing air from the air bypass passage 270 to entrain the fuel. An electrically operated valve 600 (comprising a spring biased valve member 602 and an electrical coil 603) is used to control flow of air through the air bypass passage 270 so that air can only be drawn through the passage 270 during the intake stroke of the engine (and not the expansion stroke) and so the gas cannot flow out of the combustion chamber 630 via the bypass passage 240. The valve member 602 seals on a seat 650 to prevent flow of air from an air inlet 601 via connecting passage 651 to the air bypass passage 240.

Whilst the passage 270 has been described above as an air bypass 270, the passage 270 is not limited to supplying air but could alternatively be connected to a gas supply to provide an alternative gas to aid in atomisation or combustion. One such example of another gas that could be used is exhaust gas from the engine (i.e. exhaust gas recirculation).

Figure 2:
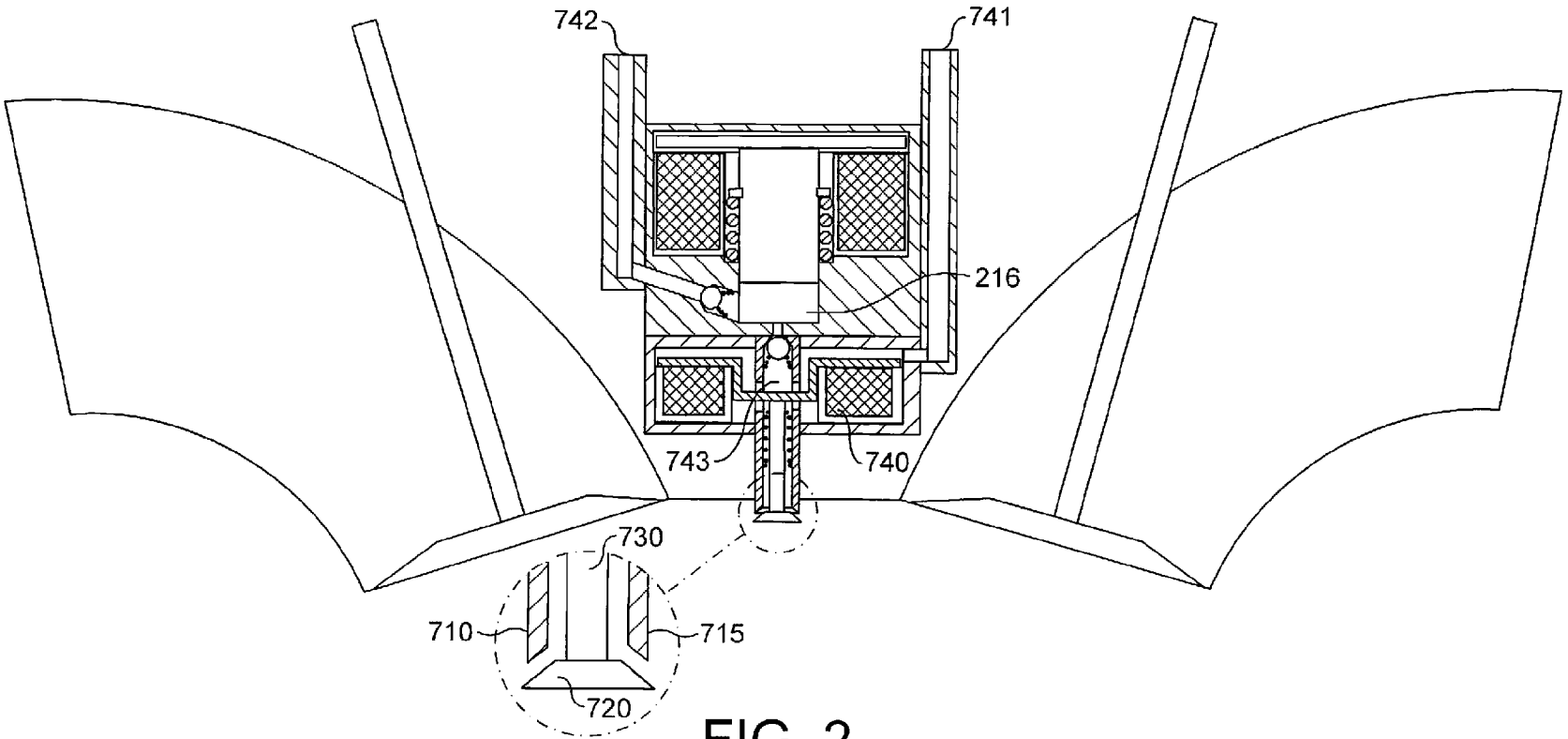
FIG. 2 is a schematic representation of a fuel injector of the present invention arranged for direct injection into the combustion chamber wherein the sonic nozzle is of the pintle type.

FIG. 2 shows a second embodiment of the invention. This is similar to the embodiment shown in FIG. 1. The fuel injector is located for direct injection of fuel into the combustion chamber of the engine. However, this embodiment includes a different type of sonic nozzle. In this case, the sonic nozzle consists of an outer tube 710 through which fuel entrained in air (or exhaust gases) flows. A pintle 720 is provided across the end of the tube inside the combustion chamber. The closure is connected to an actuating rod 730 located centrally of the outer tube 710. Importantly, the pintle 720 abuts against the outer tube 710. The abutting surfaces of both the pintle 720 and the outer tube 710 are chamfered.

Fuel supplied by supply line 742 is dispensed from the fuel mixing chamber 216 of the injector 210. At the same time the pintle closure is opened allowing fuel and air to be dispensed into the combustion chamber 630. Air (or exhaust gases) flows through passage 741 to entrain the dispersed fuel in mixing chamber 743 and deliver it to the combustion chamber. The pintle 720 is opened only when the piston in the combustion chamber is moving to draw air into the cylinder in the intake stroke. The chamfered shape of the pintle causes a spray of fuel forming a conical shape extending outwards from the pintle. Actuation of the pintle may be by means of a solenoid 740 or other means. Again, in this embodiment there is no requirement to monitor and tightly regulate the pressure in the mixing chamber 743 or the combustion chamber. A sonic velocity is achieved as the fuel is forced through the narrow gap between the closure 720 and the tube 710.

An engine with a fuel injection system as described above can be used to power a device such as a gardening device, e.g. a lawn mower, a hedge trimmer, a chain saw, a lawn aerator, a scarifier and a shredder.

Figure 4A:
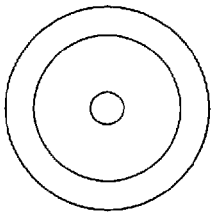
FIGS. 4*a*-4*d* show alternative nozzle orifice shapes.
Figure 4B:
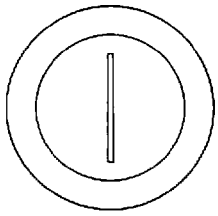
Figure 4C:
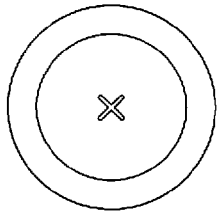
Figure 4D:
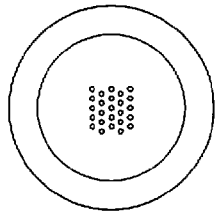

The nozzle 276 can have orifices of different shapes such as shown in FIGS. 4*a* to 4*d* to improve the atomisation of the fuel in the inlet passage. The orifice of a standard sonic nozzle, when a cross-section is taken perpendicular to the flow direction, is circular (see FIG. 4*a*). Alternative shapes of the nozzle orifices may be provided, for example a linearly extending orifice (FIG. 4*b*), a cruciform shape (FIG. 4*c*) or alternatively a plurality of smaller dispersed nozzles, each having a circular orifice (FIG. 4*d*). All of these allow the control of the fuel mist 230. The plurality of smaller dispersed nozzles provides improved atomisation.

The invention claimed is:

1. An internal combustion engine having a fuel injection system which delivers fuel directly into a combustion chamber for mixing with charge air delivered separately to the combustion chamber via an inlet valve, the fuel injection system comprising:

a fuel injector which functions as a positive displacement pump and dispenses in each operation thereof a set quantity of fuel;

a mixing chamber into which the fuel injector dispenses fuel; and a gas supply passage for supplying gas to the mixing chamber to entrain the fuel dispensed into the mixing chamber in a flow of gas which passes through the mixing chamber into the charge air; wherein:

the mixing chamber is connected to the combustion chamber to deliver fuel and gas into the combustion chamber separately from the charge air and a depression in the combustion chamber is used to draw gas through the gas supply passage into the combustion chamber; and the inlet valve controls flow of charge air into the combustion chamber and the inlet valve is kept closed for an initial part of an intake stroke of the engine so that the depression is created in the combustion chamber; and an electrically-operated valve is provided to control flow of gas from the gas supply passage through the mixing chamber.

2. The internal combustion engine of claim 1 wherein the gas supply passage supplies air drawn from atmosphere.

3. The internal combustion engine of claim 1 wherein the gas supply passage supplies combusted gases drawn from an exhaust of the engine.

4. The internal combustion engine of claim 1 wherein the gas supply passage supplies a mixture of air drawn from atmosphere and combusted gases drawn from an exhaust of the engine.

5. The internal combustion engine of claim 1 wherein the fuel injector dispenses an amount of fuel which is fixed for each and every operation of the injector.

6. The internal combustion engine of claim 1 wherein fuel and gas leaving the mixing chamber pass through an atomising nozzle prior to mixing with the charge air.

7. The internal combustion engine of claim 6, wherein the atomising nozzle is a sonic nozzle.

8. The internal combustion engine claim 6 wherein the atomising nozzle comprises a non-circular orifice through which the fuel exits into the charge air.

9. The internal combustion engine of claim 6, wherein the atomising nozzle comprises a plurality of orifices through which the fuel exits into the charge air.

10. The internal combustion engine of claim 6, wherein the atomising nozzle further includes a pintle, the pintle being part of the electrically-operated valve controlling flow of gas through the mixing chamber.

11. An internal combustion engine having a fuel injection system which delivers fuel directly into a combustion chamber for mixing with charge air delivered separately to the combustion chamber via an inlet valve, the fuel injection system comprising:

a fuel injector which functions as a positive displacement pump and dispenses in each operation thereof a set quantity of fuel;

a mixing chamber into which the fuel injector dispenses fuel; and a gas supply passage for supplying gas to the mixing chamber to entrain the fuel dispensed into the mixing chamber in a flow of gas which passes through the mixing chamber into the charge air; wherein:

the mixing chamber is connected to the combustion chamber to deliver fuel and gas into the combustion chamber separately from the charge air and a depression in the combustion chamber is used to draw gas through the gas supply passage into the combustion chamber;

the inlet valve is a cylinder head poppet valve which controls flow of charge air into the combustion chamber and the inlet valve is kept closed for an initial part of an intake stroke of the engine so that the depression is created in the combustion chamber; and the fuel injector dispenses an amount of fuel which is fixed for each and every operation of the injector; and an electrically-operated valve is provided to control flow of gas from the gas supply passage through the mixing chamber.

12. The internal combustion engine of claim 11 wherein fuel and gas leaving the mixing chamber pass through an atomising nozzle prior to mixing with the charge air.

13. The internal combustion engine of claim 12, wherein the atomising nozzle includes a pintle, the pintle being part of the electrically-operated valve controlling flow of gas through the mixing chamber.

14. An internal combustion engine having a fuel injection system which delivers fuel directly into a combustion chamber for mixing with charge air delivered separately to the combustion chamber via an inlet valve, the fuel injection system comprising:

a fuel injector which functions as a positive displacement pump and dispenses in each operation thereof a set quantity of fuel;

a mixing chamber into which the fuel injector dispenses fuel; and a gas supply passage for supplying gas to the mixing chamber to entrain the fuel dispensed into the mixing chamber in a flow of gas which passes through the mixing chamber into the charge air; wherein:

the mixing chamber is connected to the combustion chamber to deliver fuel and gas into the combustion chamber separately from the charge air and a depression in the combustion chamber is used to draw gas through the gas supply passage into the combustion chamber; and the inlet valve is a cylinder head poppet valve which controls flow of charge air into the combustion chamber and the inlet valve is kept closed for an initial part of an intake stroke of the engine so that the depression is created in the combustion chamber; and fuel and gas leaving the mixing chamber pass through an atomising nozzle prior to mixing with the charge air;

a cylinder head exhaust valve is provided to control exhaust of the combusted gases from the combustion chamber, the exhaust valve being separate from and spaced from the inlet valve and the atomising nozzle; and an electrically-operated valve is provided to control flow of gas from the gas supply passage through the mixing chamber.

15. The fuel injection system of claim 14, wherein the atomising nozzle includes a pintle, the pintle being operated simultaneously with the fuel injector.

16. An internal combustion engine having a fuel injection system which delivers fuel directly into a combustion chamber for mixing with charge air delivered separately to the combustion chamber via an inlet valve, the fuel injection system comprising:

a fuel injector which functions as a positive displacement pump and dispenses in each operation thereof a set quantity of fuel;

a mixing chamber into which the fuel injector dispenses fuel; and a gas supply passage for supplying gas to the mixing chamber to entrain the fuel dispensed into the mixing chamber in a flow of gas which passes through the mixing chamber into the charge air; wherein:

the mixing chamber is connected to the combustion chamber to deliver fuel and gas into the combustion chamber separately from the charge air and a depression in the combustion chamber is used to draw gas through the gas supply passage into the combustion chamber;

the inlet valve is a cylinder head poppet valve which controls flow of charge air into the combustion chamber and the inlet valve is kept closed for an initial part of an intake stroke of the engine so that the depression is created in the combustion chamber; and the fuel injector dispenses an amount of fuel which is fixed for each and every operation of the injector;

the fuel and gas leaving the mixing chamber pass through an atomising nozzle prior to mixing with the charge air;

a cylinder head exhaust valve is provided to control exhaust of the combusted gases from the combustion chamber, the exhaust valve being separate from and spaced from the inlet valve and the atomizing nozzle; and an electrically-operated valve is provided to control flow of gas from the gas passage through the mixing chamber, the electrically-operated valve comprising a pintle operable in the atomising nozzle.

17. An engine powered device comprising an internal combustion engine as claimed in claim 1.

18. A device according to claim 17 wherein the device is a gardening device.

19. A device according to claim 18 wherein the device is selected from the list comprising:

a lawn mover;

a hedge trimmer;

a chain saw;

a lawn aerator;

a scarifier; and a shredder.

20. A device according to claim 18 wherein the device is an engine driven vehicle.

21. A method of delivering fuel into a combustion chamber separately from charge air delivered to the combustion chamber via an inlet valve, the method comprising the steps of:

dispensing a set quantity of fuel from a fuel injector to a mixing chamber; and entraining the fuel in the mixing chamber in a flow of gas, with the flow delivering the fuel to the combustion chamber via an atomising nozzle; and controlling exhaust of combusted gases from the combustion chamber using a cylinder head exhaust valve separate from and spaced from the inlet valve and the atomizing nozzle; wherein:

a depression is created in the combustion chamber in an early part of an intake stroke of the engine by keeping closed the inlet valve and the depression is used to draw through the atomising nozzle the gas used to entrain the dispensed fuel; and an electrically-operated valve is used to control flow of gas in the mixing chamber.

* * * * *